US010851442B2

(12) United States Patent
Miura et al.

(10) Patent No.: US 10,851,442 B2
(45) Date of Patent: Dec. 1, 2020

(54) MAGNESIUM-LITHIUM ALLOY, ROLLED STOCK MADE OF MAGNESIUM-LITHIUM ALLOY, AND PROCESSED PRODUCT INCLUDING MAGNESIUM-LITHIUM ALLOY AS MATERIAL

(71) Applicant: SUBARU CORPORATION, Tokyo (JP)

(72) Inventors: Ayako Miura, Tokyo (JP); Takayuki Goto, Hyogo (JP)

(73) Assignee: SUBARU CORPORATION, Tokyo (JP)

( * ) Notice: Subject to any disclaimer, the term of this patent is extended or adjusted under 35 U.S.C. 154(b) by 2 days.

(21) Appl. No.: 15/711,280

(22) Filed: Sep. 21, 2017

(65) Prior Publication Data

US 2018/0010218 A1 Jan. 11, 2018

Related U.S. Application Data

(63) Continuation of application No. PCT/JP2016/057687, filed on Mar. 11, 2016.

(30) Foreign Application Priority Data

Mar. 25, 2015 (JP) ..... 2015-063194

(51) Int. Cl.
*C22C 23/00* (2006.01)
*B61D 15/00* (2006.01)

(52) U.S. Cl.
CPC ..... *C22C 23/00* (2013.01); *B61D 15/00* (2013.01)

(58) Field of Classification Search
CPC ..... C22C 23/00; C22C 23/02; C22C 24/00; C22F 1/06
See application file for complete search history.

(56) References Cited

U.S. PATENT DOCUMENTS 3,419,385 A * 12/1968 Foerster ..... C22C 23/06 420/404
2015/0083285 A1 3/2015 Somekawa et al.
2016/0281200 A1 9/2016 Miura
2017/0369972 A1 12/2017 Goto

FOREIGN PATENT DOCUMENTS

CN 1311066 A 9/2001
CN 102676894 A 9/2012
CN 103643096 A 3/2014
CN 104233024 A 12/2014
JP H6-279906 10/1994
JP H09-041066 A 2/1997
JP 2001-300643 A 10/2001
JP 3278232 B2 2/2002
JP 2012-057227 A 3/2012
JP 2013-007068 1/2013
JP 2015-040340 A 3/2015
WO 2009/113601 A1 9/2009
WO 2013/180122 A1 12/2013
WO 2016/121722 8/2016

OTHER PUBLICATIONS

European Search Report dated Jul. 20, 2018 in European Patent Application No. 16 768 472.9 (9 pages).
Office Action received in Chinese Patent Application No. 201680018158.9 dated Dec. 7, 2018 (7 pages in Chinese with machine translation).
International Search Report for PCT/JP2016/057687 dated Jun. 7, 2016 (4 pages in Japanese with English translation).
Written Opinion for PCT/JP2016/057687 dated Jun. 7, 2016 (10 pages in Japanese with English translation).
International Preliminary Report on Patentability for PCT/JP2016/057687 dated Sep. 26, 2017 (10 pages in Japanese with English translation).
Ramesh Chandiran et al. Semi-solid Forming Processing for Mg—Li-Ai Super-light Alloys. Abstracts of the 130th National Lecture Meeting, Apr. 30, 1997, p. 47 (6 pages in Japanese with Machine translation).
C. S. Ramesh et al. Microstructural Changes of Strain-introduced Light Mg—Li Al Alloys at Semi-solid Temperature. Abstracts of the 91st Autumn Lecture Meeting, Oct. 15, 1996, pp. 331-332 (10 pages in Japanese with Machine translation).
Kazuo Matsuzawa et al., The effect of additional element on the age-hardening characteristics and properties of Mg—Li alloys, light metals, JP, The Japan Institute of Light Metals, Sep. 1990, vol. 40, No. 9, p. 659-665 (in Japanese with English abstract).
Wang, Jian-Yih. Mechanical properties of room temperature rolled MgLiAlZn alloy. Journal of Alloys and Compounds, NL, Elsevier, Oct. 19, 2009, vol. 485, p. 241-244.
Japanese Standards Association, JIS H 0001(1998). Aluminium, magnesium and their alloys—Temper designation, JIS Handbook (3) Non-Ferrous Metals & Metallurgy, Japan, Japanese Standards Association, Jan. 19, 2007, first edition, pp. 1201-1209 (in Japanese with English Abstract).
Ohnishi, Tadakazu et al. Work-hardening and annealing characteristic of Mg—Li binary alloys. Keikinzoku—Journal of Japan Institute of Light Metals, vol. 39, No. 1, Jan. 1, 1989, pp. 15-20.
Leu, Jyh-Shyan et al. Strengthening and Room Temperature Age-Softening of Super-Light Mg—Li Alloys. Journal of Materials Engineering and Performance, vol. 19, No. 9, Jul. 17, 2009, pp. 1235-1239.

(Continued)

*Primary Examiner* — Jessee R Roe
(74) *Attorney, Agent, or Firm* — Smith, Gambrell & Russell, LLP

(57) ABSTRACT

According to one implementation, a magnesium-lithium alloy contains not less than 10.50 mass % and not more than 16.00 mass % lithium, not less than 5.00 mass % and not more than 12.00 mass % aluminum, and not less than 2.00 mass % and not more than 8.00 mass % calcium. According to one implementation, a rolled stock is made of the above-mentioned magnesium-lithium alloy. According to one implementation, a processed product includes the above-mentioned magnesium-lithium alloy as a material.

21 Claims, No Drawings

(56) References Cited

OTHER PUBLICATIONS

Chiang, Chih-Te et al. Rolling route for refining grains of super light Mg—Li alloys containing Sc and Be. Transactions of Nonferrous Metals Society of China, Nonferrous Metals Society of China, CN, vol. 20, No. 8, Aug. 1, 2010, pp. 1374-1379.

Lin, Meng-Chang et al. Effect of annealing temperature on the microstructure and mechanical properties of an as-rolled Mg—9wt.% Li—3wt.%Al—1wt.%Zn alloy sheet. Frontiers of Materials Science, Higher Education Press and Springer, Heidelberg, vol. 8, No. 3, Jul. 28, 2014, pp. 271-280.

Chiu, Chui-Hung et al. Microstructure and mechanical behavior of LZ91 Mg alloy processed by rolling and heat treatments. Journal of Alloys and Compounds, Elsevier Sequoia, Lausanne, CH, vol. 460, No. 1-2, Jul. 28, 2008, pp. 246-252.

Wu, S. K. et al. Effects of cold rolling and solid solution treatments on mechanical properties of β-phase Mg—14.3Li—0.8Zn alloy. Materials Science and Engineering A: Structural Materials: Properties, Microstructures and Processing, Elsevier BV, NL, vol. 552, Apr. 30, 2012, pp. 76-80.

Wu, Horng-yu et al. Effects of age heat treatment and thermomechanical processing on microstructure and mechanical behavior of LAZ1010 Mg Alloy. Materials Science and Engineering A: Structural Materials: Properties, Microstructures and Processing, Elsevier BV, NL, vol. 523, No. 1-2, Oct. 15, 2009, pp. 7-12.

Kazuo Matsuzawa, Toshio Koshihara, and Yo Kojima, "Age-hardening and mechanical properties of Mg—Li—Al alloys", Journal of Japan Institute of Light Metals, vol. 39 (1989), No. 1, pp. 45-51.

First European Office Action dated Mar. 13, 2019 in Patent Application No. 16 768 472.9 (6 pages).

Second Chinese Office Action dated Aug. 26, 2019 in Patent Application No. 201680018158.9 (4 pages in Chinese with English translation).

Japanese Office Action dated Jan. 30, 2020 relative to Japanese patent application 2017-508214, 3 pages (with machine translation, 4 pages).

U.S. Office Action dated Jan. 10, 2020 relative to U.S. Appl. No. 15/062,507, 8 pages.

Office Action for Chinese Patent Application No. 201680018158.9 dated Apr. 10, 2020 (6 pages with translation).

* cited by examiner

MAGNESIUM-LITHIUM ALLOY, ROLLED STOCK MADE OF MAGNESIUM-LITHIUM ALLOY, AND PROCESSED PRODUCT INCLUDING MAGNESIUM-LITHIUM ALLOY AS MATERIAL

CROSS REFERENCES TO RELATED APPLICATIONS

This is a continuation of Application PCT/JP2016/57687, filed on Mar. 11, 2016.

This application is based upon and claims the benefit of priority from Japanese Patent Application No. 2015-063194 filed on Mar. 25, 2015; the entire contents of which are incorporated herein by reference.

FIELD

Implementations described herein relate generally to a magnesium-lithium alloy, a rolled stock made of a magnesium-lithium alloy, and a processed product including a magnesium-lithium alloy as a material.

BACKGROUND

In recent years, a lightweight magnesium alloy has attracted attention as a structural metallic material. However, a rolled stock of AZ31 (3 mass % Al, 1 mass % Zn, and the balance Mg), which is a general magnesium alloy, has low cold workability and cannot be pressed unless it is heated to about 250° C. Although the crystal structure of magnesium is the hexagonal close-packed (hcp) structure (α phase), the crystal structure of a magnesium-lithium alloy, containing from 6 mass % to 10.5 mass % lithium, becomes a mixed phase of the hcp structure and the body-centered cubic (bcc) structure (β phase). Furthermore, the crystal structure of a magnesium-lithium alloy, containing not less than 10.5 mass % lithium, becomes the β-single phase. Although slip systems in the α phase are generally limited, the β phase has many slip systems. Therefore, the cold workability of a magnesium-lithium alloy improves as the content of lithium is increased and the crystal structure becomes a mixed phase of the α phase and the β phase, and the β-single phase. As such magnesium-lithium alloy, LZ91 (9 mass % Li, 1 mass % Zn, and the balance Mg), LA141 (14 mass % Li, 1 mass % Al, and the balance Mg) or the like is widely known. Although a characteristic of these magnesium-lithium alloys is lightness, there are problems of low combustion temperature and flammable.

In Japanese Patent Application Publication No. 2013-007068, it is described that flame resistance of a magnesium alloy containing not less than 2 mass % and not more than 11 mass % aluminum improves by adding not less than 0.1 mass % and not more than 10 mass % calcium. Although lithium is mentioned as one of additive elements, the content of lithium is not less than 0.01 mass % and not more than 10 mass %. This is because it is known that a magnesium-lithium alloy, containing more than 10 mass % lithium, becomes flammable as the content of lithium increases.

In Japanese Patent Application Publication No. H06-279906, it is described that a magnesium-lithium alloy containing from 4 weight % to 16 weight % lithium and not more than 4 weight % aluminum acquires an effect of suppressing combustion of magnesium by adding from 0.3 weight % to 5 weight % calcium although the effect is limited at the time of melting. However, in the case of a magnesium-lithium alloy within this composition range, the combustion temperature is still low although a little effect of improving the flame resistance can be acquired by calcium. Furthermore, there is a high possibility that a spark occurs from a magnesium-lithium alloy itself at a low temperature when the alloy is heated.

In International Publication No. WO 2009/113601, it is described that a magnesium-lithium alloy, containing not less than 10.50 mass % and not more than 16.00 mass % lithium and not less than 0.50 mass % and not more than 1.50 mass % aluminum, has satisfactory mechanical characteristics. It is also described that the corrosion resistance can be improved by adding not less than 0.10 mass % and not more than 0.50 mass % calcium to a magnesium-lithium alloy which has this composition. Furthermore, it is described that the flame resistance can be improved by making a magnesium-lithium alloy, which has the above-mentioned composition, contain not more than 5.00 mass % titanium.

An object of the present invention is to improve the flame resistance of a magnesium-lithium alloy with keeping satisfactory mechanical characteristics.

SUMMARY OF THE INVENTION

According to one implementation, a magnesium-lithium alloy that contains not less than 10.50 mass % and not more than 16.00 mass % lithium, not less than 5.00 mass % and not more than 12.00 mass % aluminum, and not less than 2.00 mass % and not more than 8.00 mass % calcium is provided.

Further, according to one implementation, the above-mentioned magnesium-lithium alloy further containing at least one of more than 0 mass % and not more than 3.00 mass % zinc, more than 0 mass % and not more than 1.00 mass % yttrium, more than 0 mass % and not more than 1.00 mass % manganese, and more than 0 mass % and not more than 1.00 mass % silicon is provided.

Further, according to implementations, the above-mentioned magnesium-lithium alloy wherein a temperature at which a spark occurs is not less than 600° C. and the above-mentioned magnesium-lithium alloy wherein a temperature at which combustion continues is not less than 650° C. are provided.

Further, according to one implementation, a rolled stock made of the above-mentioned magnesium-lithium alloy and a processed product including the above-mentioned magnesium-lithium alloy as a material are provided.

DETAILED DESCRIPTION

A magnesium-lithium alloy, a rolled stock made of a magnesium-lithium alloy, and a processed product including a magnesium-lithium alloy as a material according to implementations of the present invention will be described.

Hereinafter, the temperature at which a spark occurs from an alloy itself is called spark generation temperature, and the temperature at which an alloy continues burning is called combustion continuation temperature.

(First Implementation)

A magnesium-lithium (Mg—Li) alloy according to the first implementation consists of specific amounts of lithium (Li), aluminum (Al), calcium (Ca), impurities, and the balance magnesium (Mg).

The content of Li in an Mg—Li alloy according to the first implementation is not less than 10.50 mass % and not more than 16.00 mass %. When the content of Li is less than 10.50 mass %, an Mg—Li alloy becomes the α-single phase or the α-β eutectic texture, and shows poor cold workability. When the content of Li exceeds 16.00 mass %, the corrosion resistance and strength of an obtained alloy deteriorate, and the alloy does not bear practical use.

The crystal structure of the conventional Mg—Li alloy, in which the content of Al is not a specific amount to be described, becomes the β-single phase when not less than 10.50 mass % Li is contained. By contrast, an Mg—Li alloy according to the first implementation contains a specific amount of Al to be described. Therefore, an aluminum intermetallic compound phase is precipitated in addition to the β phase which is the main phase. Hence, an Mg—Li alloy according to the first implementation is light and excellent in workability.

When the amount of Li increases, an alloy tends to become flammable. Usually, the more the amount of Li increases, the more the flame resistance may deteriorate. However, the following specific amount of Al and Ca are added to an Mg—Li alloy according to the first implementation. Thereby, even an Mg—Li alloy, in which a range of the content of Li is not less than 10.50 mass % and not more than 16.00 mass %, can also obtain high flame resistance.

The content of Al in an Mg—Li alloy according to the first implementation is not less than 3.00 mass % and not more than 12.00 mass %, and preferably not less than 5.00 mass % and not more than 12.00 mass %. When the content of Al is less than 3.00 mass %, a combustion continuation temperature of an obtained Mg—Li alloy becomes low. Meanwhile, when the content of Al exceeds 12.00 mass %, a spark generation temperature and a combustion continuation temperature of an obtained Mg—Li alloy decrease. That is, an improvement effect in flame resistance cannot be obtained unless the content of Al is within the above-mentioned range. Furthermore, a specific gravity of an obtained Mg—Li alloy becomes large, and lightness is lost.

The amount of Ca in an Mg—Li alloy according to the first implementation is not less than 2.00 mass % and not more than 8.00 mass %, preferably not less than 3.00 mass % and not more than 8.00 mass %, more preferably not less than 3.00 mass % and not more than 7.00 mass %. Ca gives an improvement effect in flame resistance and especially contributes to improving a combustion continuation temperature.

When Ca is contained, compounds of Mg and Ca are formed. The compounds of Mg and Ca serve as starting points of nucleation at the time of recrystallization, and form a recrystallization texture having minute crystal grains. That is, since corrosion of an Mg—Li alloy progresses selectively at crystal grain boundaries, micronization of crystals can prevent the progress of corrosion. Specifically, the corrosion resistance of an Mg—Li alloy can be improved by detailed grain boundaries formed by compounds of Mg and Ca.

When the content of Ca is less than 2.00 mass %, the spark generation temperature decreases and an improvement effect of the flame resistance cannot be obtained. While the content of Ca exceeding 8.00 mass % can achieve an improvement effect of the flame resistance, an alloy does not bear practical use due to deterioration in strength and workability of the alloy. The spark generation temperature can be raised by containing a predetermined amount of Ca although the temperature differs depending on composition of an obtained alloy. In addition, when a predetermined amount of Ca is added to an Mg—Li alloy, it becomes possible to reduce a temperature difference between the spark generation temperature and the combustion continuation temperature, or to make the spark generation temperature same as the combustion continuation temperature. That is, when a predetermined amount of Ca is added to an Mg—Li alloy, an improvement effect of the flame resistance can be obtained.

Furthermore, it was confirmed that an improvement effect of the flame resistance could be obtained by adding specific amounts of Al and Ca while the above-mentioned Japanese Patent Application Publication No. 2013-007068 taught that the improvement effect of the flame resistance could not be obtained in an Mg—Li alloy in which the content of Li exceeding 10 mass %. That is, it was confirmed that even an Mg—Li alloy, in which the content of Li exceeding 10 mass %, could have more excellent flame resistance by containing a specific amount of Al and a specific amount of Ca. Note that, it was also confirmed that both the spark generation temperature and the combustion continuation temperature might decrease when both Al and Ca were out of the specific amounts. Furthermore, it was also confirmed that especially both the spark generation temperature and the combustion continuation temperature might decrease when only Al was out of the specific amount, and conversely, especially the spark generation temperature might decrease when Ca was out of the specific amount.

As described above, an Mg—Li alloy according to the first implementation has improved flame resistance with keeping satisfactory cold workability and satisfactory tensile strength by containing appropriate contents of Al and Ca. Specifically, since the Mg—Li alloy contains not less than 10.50 mass % lithium, the crystal structure of the Mg—Li alloy becomes β-single phase which is excellent in cold workability. Moreover, excellent tensile strength is given to the Mg—Li alloy by adding Al. Furthermore, the spark generation temperature and the combustion continuation temperature can be raised by making the Mg—Li alloy contain appropriate contents of Al and Ca, respectively. That is, the flame resistance can be improved.

(Second Implementation)

An Mg—Li alloy according to the second implementation consists of specific amounts of Li, Al, Ca, at least one additive element, impurities, and the balance Mg. Note that, the additive element is at least one selected out of a group consisting of zinc (Zn), yttrium (Y), manganese (Mn), and silicon (Si). The content of Zn is more than 0 mass % and not more than 3.00 mass %, the content of Y is more than 0 mass % and not more than 1.00 mass %, the content of Mn is more than 0 mass % and not more than 1.00 mass %, and the content of Si is more than 0 mass % and not more than 1.00 mass %, respectively as an additive element.

Containing Zn or Y as an additive element can further improve the workability of an obtained Mg—Li alloy. Mn easily forms an intermetallic compound with iron (Fe). Therefore, containing Mn can improve the corrosion resistance of an obtained Mg—Li alloy. Furthermore, containing Si can further improve the high-temperature strength of an obtained Mg—Li alloy. Note that, when the content of Zn exceeds 3.00 mass % or the content of Si exceeds 1.00 mass %, the strength and the workability of an obtained Mg—Li alloy may deteriorate. When the content of Y exceeds 1.00 mass %, the high-temperature strength of an obtained Mg—Li alloy may deteriorate. When the content of Mn exceeds 1.00 mass %, the lightness of an obtained Mg—Li alloy may be lost.

That is, an additive element or additive elements are added to an Mg—Li alloy in the second implementation in order to improve the characteristics of an Mg—Li alloy in the first implementation. Therefore, an Mg—Li alloy in the second implementation can achieve more satisfactory characteristics than the characteristics of an Mg—Li alloy in the first implementation.

(Other Implementations)

An Mg—Li alloy according to the first and the second implementations can contain at least one, selected out of a group consisting of zirconium (Zr), titanium (Ti), boron (B), and rare earth metal elements whose atomic numbers are 57-71, as an optional component in addition to the above-mentioned elements, within a range in which a large influence does not arise on an improvement effect of the flame resistance of the Mg—Li alloy. For example, when Zr is contained, the strength of an obtained Mg—Li alloy further improves. When Ti is contained, the flame resistance improves. When a rare earth element is contained, an elongation of an obtained Mg—Li alloy improves, and the cold workability further improves. A rare earth element preferably includes lantern (La), cerium (Ce), praseodymium (Pr), and neodymium (Nd). The content of each optional component is preferably not less than 0 mass % and not more than 5.00 mass %. When an Mg—Li alloy contains a large amount of an optional component or optional components, a specific gravity becomes large and the characteristic that an Mg—Li alloy is lightweight is impaired. Thus, it is preferable to reduce the content of each optional component as much as possible.

As described above, manufacturing an Mg—Li alloy, which contains at least not less than 10.50 mass % and not more than 16.00 mass % Li, not less than 3.00 mass % and not more than 12.00 mass % Al, and not less than 2.00 mass % and not more than 8.00 mass % Ca, can obtain characteristics similar to those of an Mg—Li alloy in the first implementation. Furthermore, manufacturing an Mg—Li alloy, which further contains at least one of more than 0 mass % and not more than 3.00 mass % Zn, more than 0 mass % and not more than 1.00 mass % Y, more than 0 mass % and not more than 1.00 mass % Mn, and more than 0 mass % and not more than 1.00 mass % Si, can obtain characteristics similar to those of an Mg—Li alloy in the second implementation.

(Impurities)

Examples of impurities contained in an Mg—Li alloy include, for example, Fe, nickel (Ni), and copper (Cu). A minute amount of impurities may be contained in an Mg—Li alloy to the extent that the impurities do not influence an improvement effect in the strength and the flame resistance of an obtained Mg—Li alloy. A concentration of Fe as an impurity contained in an Mg—Li alloy is not more than 15 ppm, preferably not more than 10 ppm. When the Fe concentration exceeds 15 ppm, the corrosion resistance deteriorates. A concentration of Ni as an impurity contained in an Mg—Li alloy is preferably not more than 15 ppm, more preferably not more than 10 ppm. It is not preferable to contain a large amount of Ni since the corrosion resistance of an obtained Mg—Li alloy deteriorates. An effect of improving the corrosion resistance by reducing the Ni impurity concentration can also be obtained in an Mg—Li alloy containing not less than 10.50 mass % Li as well as an effect obtained by reducing the Fe impurity concentration. A concentration of Cu as an impurity contained in an Mg—Li alloy is preferably not more than 10 ppm. Controlling the Cu concentration to not more than 10 ppm allows further improving the corrosion resistance of an obtained Mg—Li alloy.

(Characteristics of Mg—Li Alloy)

Each of the spark generation temperature and the combustion continuation temperature of an Mg—Li alloy is an index for determining relative merits of the flame resistance. The higher the temperatures are, the more an Mg—Li alloy is excellent in the flame resistance. The spark generation temperatures and the combustion continuation temperatures were measured by a flame resistance evaluation test under the following method.

Each spark generation temperature was measured as follows. At first, a test piece was cut out into 20 mm×20 mm×1 mm thickness from a plate made of an Mg—Li alloy having the above-mentioned composition, and set in a refractory crucible disposed in a resistance heating furnace. Next, the top of the crucible was covered by a non-combustible material, such as ceramic fiber wool, and subsequently, the crucible was heated in the air atmosphere. Next, a rising temperature of the test piece was checked with a thermocouple, and the measured temperature was considered as a temperature of the test piece. Then, the spark generation temperature was considered as a temperature of the test piece at the time when generation of a spark or a momentary flame was visually observed in the test piece whose temperature had risen by heating. Here, the spark generation temperature refers to a temperature at which a spark or a momentary flame occurred, and differs from a temperature at which the test piece itself burns continuously.

Meanwhile, the combustion continuation temperature was measured upon continued heating further after the measurement of the spark generation temperature. Specifically, a temperature, at which the test piece itself continued burning, due to the rising the temperature of the test piece, with a spark or a momentary flame as a trigger, was considered as the combustion continuation temperature. Here, the combustion continuation temperature refers to a visually observed temperature of the test piece when the combustion has started in case that the combustion has continued.

As a result of measurement, it was confirmed that the spark generation temperature and the combustion continuation temperature vary depending on composition of Mg—Li alloy, as shown in Table 1. Specifically, it was confirmed that the spark generation temperature differed from the combustion continuation temperature in some cases, and combustion started when the temperature rose up to a specific value after the generation of a spark. Conversely, it was confirmed that the spark generation temperature was same as the combustion continuation temperature in some cases, and combustion started simultaneously with the generation of a spark.

TABLE 1

| | Alloy composition (wt %) | | | | | Flame resistance measurement result (° C.) | |
|---|---|---|---|---|---|---|---|
| | Mg | Li | Al | Ca | Additive element | Spark generation temperature | Combustion continuation temperature |
| Example 1 | Bal. | 14.03 | 5.01 | 2.87 | — | 650 | 650 |
| Example 2 | Bal. | 14.11 | 7.20 | 6.51 | — | 680 | 680 |

TABLE 1-continued

| | Alloy composition (wt %) | | | | | Flame resistance measurement result (° C.) | |
|---|---|---|---|---|---|---|---|
| | | | | | | Spark | Combustion |
| | Mg | Li | Al | Ca | Additive element | generation temperature | continuation temperature |
| Example 3 | Bal. | 13.76 | 10.01 | 4.70 | — | 680 | 680 |
| Example 4 | Bal. | 14.52 | 10.77 | 3.04 | Y:0.05 | 680 | 680 |
| Example 5 | Bal. | 13.96 | 11.58 | 3.87 | Mn:0.19 | 760 | 760 |
| Example 6 | Bal. | 13.92 | 11.22 | 4.50 | Mn:0.19 | 780 | 780 |
| Example 7 | Bal. | 14.41 | 11.27 | 2.03 | Y:0.03 | 630 | 680 |
| Example 8 | Bal. | 14.04 | 11.78 | 2.10 | Mn:0.09 | 620 | 780 |
| Example 9 | Bal. | 14.07 | 11.73 | 2.02 | Ce:0.14 | 610 | 780 |
| Example 10 | Bal. | 14.08 | 11.58 | 2.02 | La:0.36 | 610 | 780 |
| Example 11 | Bal. | 13.96 | 3.01 | 3.00 | Mn:0.22 | 620 | 640 |
| Comparative Example 1 | Bal. | 13.72 | 1.08 | 0.28 | — | 560 | 570 |
| Comparative Example 2 | Bal. | 13.84 | 2.45 | 0.27 | — | 550 | 570 |
| Comparative Example 3 | Bal. | 13.99 | 3.51 | 0.31 | — | 510 | 570 |
| Comparative Example 4 | Bal. | 13.84 | 4.02 | 0.28 | — | 520 | 570 |
| Comparative Example 5 | Bal. | 13.92 | 4.82 | 0.30 | — | 460 | 580 |
| Comparative Example 6 | Bal. | 13.81 | 6.07 | 1.35 | — | 540 | 650 |
| Comparative Example 7 | Bal. | 12.89 | 5.90 | 0.99 | — | 520 | 610 |
| Comparative Example 8 | Bal. | 13.70 | 6.08 | 0.32 | — | 510 | 610 |
| Comparative Example 9 | Bal. | 13.98 | 7.50 | 0.31 | — | 500 | 650 |
| Comparative Example 10 | Bal. | 14.15 | 7.18 | 0.32 | Y:0.18 | 510 | 635 |
| Comparative Example 11 | Bal. | 13.90 | 8.76 | 0.29 | — | 470 | 670 |
| Comparative Example 12 | Bal. | 14.09 | 8.67 | 0.86 | Mn:0.23 | 550 | 680 |
| Comparative Example 13 | Bal. | 14.12 | 8.70 | 1.38 | Y:0.04 | 560 | 650 |
| Comparative Example 14 | Bal. | 13.77 | 11.84 | 0.30 | — | 480 | 710 |
| Comparative Example 15 | Bal. | 14.01 | 14.54 | 0.29 | — | 460 | 650 |
| Comparative Example 16 | Bal. | 8.92 | 6.19 | 2.56 | — | 570 | 740 |
| Comparative Example 17 | Bal. | 13.83 | 14.23 | 3.03 | — | 480 | 560 |

Each alloy shown in Table 1 was manufactured by the following method. Firstly, raw materials having corresponding composition were heated and melted, thereby a molten alloy was obtained. Next, the molten alloy was cast into a mold of 150 mm×300 mm×500 mm, thereby an alloy ingot was produced. Note that, each composition shown in Table 1 is one of the alloy ingot, measured by a quantitative analysis by the inductively coupled plasma (ICP) emission spectrometric analysis.

Next, after the alloy ingot was heat treated at 300° C. for 24 hours, a slab for rolling of 130 mm in thickness was produced by cutting the surface. Next, the slab for rolling was rolled at 350° C. to have the board thickness of 4 mm. Furthermore, the slab for rolling was rolled at rolling reduction of 75% at room temperature until the board thickness became 1 mm. The rolled object obtained thereby was subjected to annealing heat treatment at 230° C. for 1 hour. A test piece of 20 mm×20 mm×1 mm thickness was cut out from the rolled stock of 1 mm in thickness after the heat treatment.

Results of flame resistance evaluation tests using test pieces manufactured by the above-mentioned method are the spark generation temperatures and the combustion continuation temperatures shown in Table 1.

As shown in Table 1, the spark generation temperature and the combustion continuation temperature of an Mg—Li alloy change depending on composition of the Mg—Li alloy. In other words, the spark generation temperature and the combustion continuation temperature can be changed by preparing composition of an Mg—Li alloy.

The spark generation temperature of an Mg—Li alloy is preferable to be not less than 600° C. by making composition of the Mg—Li alloy appropriate. This is because the spark generation temperature of less than 600° C. may lead to ignition of an Mg—Li alloy at not more than the melting point. Meanwhile, the combustion continuation temperature of an Mg—Li alloy is preferable to be not less than 650° C. by making composition of the Mg—Li alloy appropriate. This is because the combustion continuation temperature of less than 650° C. may cause continued burning at not more than the melting point of an Mg alloy, thereby an Mg—Li alloy may not be processed or used, similarly to the Mg alloy.

Other characteristics of an Mg—Li alloy can be also made preferred by preparing composition of an Mg—Li alloy.

For example, an average crystal grain diameter of an Mg—Li alloy is preferable to be not more than 40 μm, especially not more than 20 μm, by making composition of the Mg—Li alloy appropriate. The average crystal grain diameter can be measured by a linear analysis using an observation image of a sectional structure of an Mg—Li alloy by an optical microscope. A sample etched with 5% ethanol nitrate was actually observed with being magnified by 200 times with an optical microscope. Specifically, an obtained observation image was divided into six equal parts by drawing five line segments each having the length of 600 μm, and the number of grain boundaries crossing each line segment was measured. Then, the length 600 μm of the line segment was divided by the measured number of grain boundaries for each line segment, and an average value of the divided values was considered as the average crystal grain diameter.

Tensile strength of an Mg—Li alloy can be not less than 160 MPa by making composition of the Mg—Li alloy appropriate. Thereby, strength can be obtained so that the cold workability is not deteriorated. Such tensile strength shows a value equivalent to or exceeding a value of tensile strength of LA141 or LZ91, which are the conventional Mg—Li alloys. Tensile strength of an Mg—Li alloy can be measured using No. 5 test pieces of Japanese Industrial Standards (JIS), each having a thickness of 1 mm, which have been cut out from a plate. The test pieces are cut out in three directions of 0°, 45°, and 90° from a preferably determined direction. Then, tensile strength of each test piece at 25° C. can be measured at the tensile rate of 10 mm/minute, and the tensile strength of an Mg—Li alloy can be measured as the maximum value of average values of the tensile strengths of the test pieces corresponding to 0°, 45°, and 90° directions.

(Method of Manufacturing Mg—Li Alloy)

A method of manufacturing an Mg—Li alloy, having the above-mentioned composition and physical properties, can be favorably determined. An example of the method will be described below.

Firstly, raw materials of an alloy having the above-mentioned composition are prepared in process (a). Specifically, alloy raw materials are prepared by blending metals, which contain elements contained in an Mg—Li alloy having intended composition, with a mother alloy so as to have the above-mentioned composition.

Next, the alloy raw materials are melted, cooled and solidified to become an alloy ingot (slab) in process (b). For example, the alloy ingot can be manufactured by casting a molten material of the alloy raw materials into a mold, and subsequently cooling and solidifying the molten material. Alternatively, the alloy ingot can be manufactured by cooling and solidifying a molten material of the alloy raw materials by continuous casting, such as the strip casting method. Thereby, an alloy ingot, which has a thickness of about from 10 mm to 300 mm, is usually obtained.

A homogenized heat treatment of the alloy ingot obtained in process (b) may also be performed in process (b1) under conditions usually at 200° C.-300° C. for from 1 hour to 24 hours. Furthermore, the alloy ingot obtained in process (b) or process (b1) may also be hot rolled in process (b2) usually at 200° C.-400° C.

As another method of manufacturing an Mg—Li alloy having the above-mentioned composition and physical properties, there is a method of giving a strain to an alloy ingot of an Mg—Li alloy by a cold working after a solution treatment, and progressing an aging without a heat treatment after giving the strain. According to this method, elongation of an Mg—Li alloy can be improved.

(Rolled Stock of Mg—Li Alloy)

When an ingot of an Mg—Li alloy is obtained, a rolled stock of the Mg—Li alloy excellent in flame resistance can be manufactured. The thickness of a rolled stock is usually about 0.01 mm-5 mm. A rolled stock can be manufactured by performing cold plastic forming of an ingot of an Mg—Li alloy so that the rolling reduction becomes preferably not less than 30%, and subsequently heat treating.

The cold plastic forming of an ingot can be performed by a known method, such as rolling, forging, extrusion, or drawing, for example. Strain is given to an Mg—Li alloy by this plastic forming. The temperature in the cold plastic forming is usually about from room temperature to 300° C. Performing the cold plastic forming at room temperature or at a temperature as low as possible is preferable to give large strain. The rolling reduction in the plastic forming of an ingot is preferably not less than 40%, more preferably not less than 45%, and most preferably not less than 90%. The maximum rolling reduction in the plastic forming is not especially limited.

The heat treatment to be performed subsequently is an annealing process which recrystallizes the alloy to which the strain has been given at least to some extent by the above-mentioned plastic forming. This heat treatment can be performed under conditions preferably from 150° C. to less than 350° C. for 10 minutes-12 hours, or at 250° C.-400° C. for 10 seconds-30 minutes, especially preferably at 180° C.-300° C. for 30 minutes-4 hours, or at 250° C.-350° C. for 30 seconds-20 minutes. While the heat treatment under conditions other than the above may result in deteriorating the strength of a rolled stock to be obtained, there is no particular influence on the flame resistance.

The rolled stock of the Mg—Li alloy manufactured in this way can obtain high dimensional accuracy without a crack or poor appearance since an ingot of the Mg—Li alloy excellent in a cold workability is used. Since the rolled stock of the Mg—Li alloy has satisfactory flame resistance, production efficiency of a molded product or the like can be improved. The rolled stock of the Mg—Li alloy can be used as a material for a chassis of mobile audio equipment, a digital camera, a mobile phone, a laptop or the like, or a material for a molded product, such as automobile parts or aircraft parts, for example.

(Processed Product of Mg—Li Alloy)

When an ingot or a rolled stock of the Mg—Li alloy is obtained, a processed product of the Mg—Li alloy excellent in flame resistance can be manufactured using the Mg—Li alloy as a material. The processed product of the Mg—Li alloy can be manufactured by molding processing or machining processing of the ingot or the rolled stock of the Mg—Li alloy as a material.

Surface treatments of the processed product may be performed as necessary. Known methods of an Mg based alloy or an Mg—Li alloy can be applied as the surface processing. For example, a degreasing process using an organic solvent, such as a hydrocarbon or an alcohol, can be first performed. Next, a blast treatment process for removing an oxide film on the surface or roughening the surface, and/or an etching process using an acid or an alkali can be performed as necessary, respectively. Then, a chemical conversion coating process or an anodic oxidation treatment process can be performed.

The chemical conversion coating process can be performed by a known method, such as chromate treatment or non-chromate treatment, standardized by JIS, for example. The anodic oxidation treatment process can be performed by appropriately determining electrolytic conditions, such as an electrolytic solution, a film forming stabilizer, a current density, a voltage, a temperature, and a period, for example.

A painting process can be performed after the chemical conversion coating process or the anodic oxidation treatment process, as necessary. The painting process can be performed by a known method, such as an electrodeposition coating, a spray painting, or a dip coating. For example, a known organic paint or inorganic paint is used. As for an Mg—Li alloy, applying FPF (Finger Print Free) processing (vitreous coating), performed with a Ti alloy or the like, after the anodic oxidation treatment process instead of the painting process can also form an excellent film having a high adhesion and a high density. Further, a process of heat treatment may be performed before and after the surface treatment, as necessary.

While certain implementations have been described, these implementations have been presented by way of example only, and are not intended to limit the scope of the invention. Indeed, the novel methods and systems described herein may be embodied in a variety of other forms; furthermore, various omissions, substitutions and changes in the form of the methods and systems described herein may be made without departing from the spirit of the invention. The accompanying claims and their equivalents are intended to cover such forms or modifications as would fall within the scope and spirit of the invention.

What is claimed is:

1. A magnesium-lithium alloy that contains not less than 10.50 mass % and not more than 16.00 mass % lithium, not less than 10.01 mass % and not more than 12.00 mass % aluminum, and not less than 3.87 mass % and not more than 8.00 mass % calcium, and at least one of more than 0 mass % and not more than 1.00 mass % yttrium and more than 0 mass % and not more than 1.00 mass % manganese.

2. The magnesium-lithium alloy according to claim 1, further containing at least one of more than 0 mass % and not more than 3.00 mass % zinc, and more than 0 mass % and not more than 1.00 mass % silicon.

3. A rolled stock made of the magnesium-lithium alloy according to claim 2.

4. A processed product including the magnesium-lithium alloy according to claim 2 as a material.

5. The magnesium-lithium alloy according to claim 1, wherein a temperature at which a spark occurs is not less than 680° C.

6. A rolled stock made of the magnesium-lithium alloy according to claim 5.

7. A processed product including the magnesium-lithium alloy according to claim 5 as a material.

8. The magnesium-lithium alloy according to claim 1, wherein a temperature at which combustion continues is not less than 680° C.

9. A rolled stock made of the magnesium-lithium alloy according to claim 1.

10. A processed product including the magnesium-lithium alloy according to claim 1 as a material.

11. A magnesium-lithium alloy that contains not less than 10.50 mass % and not more than 16.00 mass % lithium, not less than 5.00 mass % and not more than 12.00 mass % aluminum, and not less than 2.00 mass % and not more than 8.00 mass % calcium wherein a temperature at which a spark occurs is not less than 600° C., and wherein a temperature at which combustion continues is not less than 650° C.

12. A rolled stock made of the magnesium-lithium alloy according to claim 11.

13. A processed product including the magnesium-lithium alloy according to claim 11 as a material.

14. The magnesium-lithium alloy according to claim 11, wherein a temperature at which a spark occurs is not less than 650° C., and wherein a temperature at which combustion continues is not less than 680° C.

15. The magnesium-lithium alloy according to claim 11, wherein a temperature at which combustion continues is not less than 680° C.

16. The magnesium-lithium alloy according to claim 15 wherein there is present more than 0 mass % and not more than 1.00 mass % manganese.

17. The magnesium-lithium alloy according to claim 11 wherein an average crystal grain diameter of the magnesium-lithium alloy is not more than 20 μm.

18. A magnesium-lithium alloy that contains not less than 10.50 mass % and not more than 16.00 mass % lithium, not less than 11.22 mass % and not more than 12.00 mass % aluminum, and not less than 3.87 mass % and not more than 8.00 mass % calcium wherein a temperature at which a spark occurs is not less than 600° C., and wherein a temperature at which combustion continues is not less than 650° C.

19. The magnesium-lithium alloy according to claim 18 wherein there is present more than 0 mass % and not more than 1.00 mass % manganese.

20. The magnesium-lithium alloy according to claim 18 wherein there is present not less than 3.87 mass % and not more than 4.5 mass % calcium.

21. A rolled stock made of the magnesium-lithium alloy according to claim 18.

* * * * *